US011137141B2

(12) United States Patent
Miyauchi et al.

(10) Patent No.: US 11,137,141 B2
(45) Date of Patent: Oct. 5, 2021

(54) COMBUSTOR AND GAS TURBINE COMPRISING SAME

(71) Applicant: MITSUBISHI HITACHI POWER SYSTEMS, LTD., Kanagawa (JP)

(72) Inventors: Kotaro Miyauchi, Yokohama (JP); Koichi Nishida, Yokohama (JP); Shinji Akamatsu, Yokohama (JP); Keijiro Saito, Tokyo (JP); Satoshi Takiguchi, Tokyo (JP); Toshihiko Saito, Tokyo (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 626 days.

(21) Appl. No.: 15/510,025

(22) PCT Filed: Sep. 1, 2015

(86) PCT No.: PCT/JP2015/074833
§ 371 (c)(1),
(2) Date: Mar. 9, 2017

(87) PCT Pub. No.: WO2016/047393
PCT Pub. Date: Mar. 31, 2016

(65) Prior Publication Data

US 2017/0307218 A1 Oct. 26, 2017

(30) Foreign Application Priority Data

Sep. 22, 2014 (JP) ..... JP2014-192498

(51) Int. Cl.
*F23R 3/10* (2006.01)
*F23R 3/04* (2006.01)
(Continued)

(52) U.S. Cl.
CPC ..... *F23R 3/10* (2013.01); *F23R 3/04* (2013.01); *F23R 3/286* (2013.01); *F23R 3/343* (2013.01)

(58) Field of Classification Search
CPC .. F23R 3/343; F23R 3/286; F23R 3/04; F23R 3/10; F23R 2900/03042
See application file for complete search history.

(56) References Cited

U.S. PATENT DOCUMENTS 6,367,262 B1 * 4/2002 Mongia ..... F23R 3/14 60/748
2008/0184708 A1 8/2008 Moriwaki et al.
(Continued)

FOREIGN PATENT DOCUMENTS

CN 101023302 8/2007
CN 101813315 8/2010
(Continued)

OTHER PUBLICATIONS

International Search Report dated Dec. 1, 2015 in corresponding International (PCT) Application No. PCT/JP2015/074833.
(Continued)

*Primary Examiner* — Katheryn A Malatek
(74) *Attorney, Agent, or Firm* — Wenderoth, Lind & Ponack, L.L.P.

(57) ABSTRACT

A combustor includes a nozzle, a burner cylinder surrounding the outer circumference of the nozzle, and an outside flow path cylinder surrounding the outer circumference of a downstream end portion of the burner cylinder. A purge air flow path through which air flows is formed between the inner circumferential side of the outside flow path cylinder and the outer circumferential side of the burner cylinder. A tapered surface is formed in the downstream end portion of the burner cylinder such that the plate thickness of a burner
(Continued)

cylinder-forming plate that forms the burner cylinder gradually thins toward the downstream side.

7 Claims, 8 Drawing Sheets

(51) Int. Cl.
*F23R 3/28* (2006.01)
*F23R 3/34* (2006.01)

(56) References Cited

U.S. PATENT DOCUMENTS

| | | | | |
|---|---|---|---|---|
| 2010/0212322 | A1 | 8/2010 | York et al. | |
| 2010/0308135 | A1 | 12/2010 | Yamamoto et al. | |
| 2010/0319350 | A1* | 12/2010 | Landry | F02C 7/22 60/748 |
| 2011/0088401 | A1* | 4/2011 | Mancini | F23R 3/286 60/737 |

FOREIGN PATENT DOCUMENTS

| | | |
|---|---|---|
| JP | 9-318061 | 12/1997 |
| JP | 2005-106411 | 4/2005 |
| JP | 2005-315457 | 11/2005 |
| JP | 2010-281483 | 12/2010 |
| TW | 358850 | 5/1999 |
| TW | 489172 | 6/2002 |

OTHER PUBLICATIONS

Written Opinion of the International Searching Authority dated Dec. 1, 2015 in corresponding Application No. PCT/JP2015/074833.
Office Action dated Oct. 6, 2016 in corresponding Taiwanese Application No. 104129517.

* cited by examiner

COMBUSTOR AND GAS TURBINE COMPRISING SAME

TECHNICAL FIELD

The present invention relates to a combustor and a gas turbine comprising the same.

This application claims priority based on Japanese Patent Application No. 2014-192498 filed in Japan on Sep. 22, 2014, the contents of which are incorporated herein by reference.

BACKGROUND ART

For example, a combustor disclosed in Patent Document 1, indicated below, includes a nozzle, having a rod-shaped portion, that sprays fuel, and a cylinder, surrounding the outer circumference of the nozzle, that jets air and the fuel from the nozzle toward a downstream side.

CITATION LIST

Patent Document

Patent Document 1: Japanese Unexamined Patent Application Publication No. 2005-315457A

SUMMARY OF INVENTION

Technical Problem

The fuel is burned in the combustor, and a combustion gas produced by that burning flows in the combustor. The combustor thus has multiple components present in a high-temperature environment. What is needed, therefore, is a way to extend the service life of a combustor including such components.

Accordingly, an object of the present invention is to provide a combustor that can have an extended service life, as well as a gas turbine including such a combustor.

Solution to Problem

According to an aspect of the invention for achieving the above-described object, a combustor includes:

a nozzle, having a rod-shaped portion centered on a burner axis, that sprays fuel; a burner cylinder, having a cylindrical shape surrounding an outer circumference of the nozzle, that jets air and fuel from the nozzle from an upstream side corresponding to one side in an axial direction along which the burner axis extends, toward a downstream side corresponding to another side in the axial direction; and an outside flow path cylinder, surrounding an outer circumference of at least a downstream end portion of the burner cylinder, that forms, between an outer circumferential side of the burner cylinder and an inner circumferential side of the outside flow path cylinder, a purge air flow path along which air flows toward the downstream side. In this combustor, a tapered surface is formed in the downstream end portion of the burner cylinder such that a plate thickness of a burner cylinder-forming plate that forms the burner cylinder gradually thins as the burner cylinder-forming plate extends toward the downstream side, and a tapered surface formation width of the tapered surface in a plate thickness direction is no less than half a plate thickness of a part of the burner cylinder-forming plate where the tapered surface is not formed.

According to this combustor, the tapered surface is formed in the downstream end portion of the burner cylinder, and thus it is difficult for a gas containing fuel flowing on an inner circumferential side of the burner cylinder and air flowing on the outer circumferential side of the burner cylinder to form vortices on a downstream side of a downstream end of the burner cylinder. As such, according to this combustor, the possibility of flames forming near the downstream end of the burner cylinder can be reduced.

Incidentally, forming even a slight tapered surface in the downstream end portion of the burner cylinder makes it possible to achieve the effect of suppressing vortices to at least a small degree. However, it becomes easier for the gas containing the fuel and the air to form vortices on the downstream side of the downstream end of the burner cylinder when the tapered surface formation width of the tapered surface in the plate thickness direction is less than half the plate thickness of the part of the burner cylinder-forming plate where the tapered surface is not formed. Furthermore, these vortices increase the possibility of flames forming near the downstream end of the burner cylinder.

As opposed to this, when the tapered surface formation width of the tapered surface in the plate thickness direction is no less than half the plate thickness of the part of the burner cylinder-forming plate where the tapered surface is not formed, the gas containing the fuel and the air will substantially not form vortices on the downstream side of the downstream end of the burner cylinder; or, even if such vortices are formed, those vortices will be small. In the case where, for example, the tapered surface formation width of the tapered surface in the plate thickness direction is 60% of the plate thickness of the part of the burner cylinder-forming plate where the tapered surface is not formed, there is a possibility of the gas containing the fuel and the air forming small vortices on the downstream side of the downstream end of the burner cylinder. However, with such small vortices, it can be said that there is substantially no possibility of flames forming near the downstream end of the burner cylinder. Thus, according to this combustor, the tapered surface formation width of the tapered surface in the plate thickness direction is set to no less than half the plate thickness of the part of the burner cylinder-forming plate where the tapered surface is not formed.

Here, in the combustor according to the above-described aspect, an outer tapered surface may be formed in the outer circumferential side of the burner cylinder as the tapered surface, and a tapered surface formation width of the outer tapered surface in the plate thickness direction may be no less than half the plate thickness of the part of the burner cylinder-forming plate where the tapered surface is not formed.

According to this combustor, the air flowing along the outer circumferential side of the burner cylinder flows along the outer tapered surface, and thus this air approaches the burner axis while flowing toward the downstream side. As such, according to this combustor, a situation in which the gas containing the fuel flowing along the inner circumferential side of the burner cylinder spreads out in radial directions relative to the burner axis can be suppressed.

Additionally, in the combustor according to the above-described aspect, as the tapered surface, an outer tapered surface may be formed in the outer circumferential side of the burner cylinder and an inner tapered surface may be formed in an inner circumferential side of the burner cylinder, and a width obtained by combining the tapered surface formation width of the outer tapered surface in the plate thickness direction and a taper formation width of the inner tapered surface in the plate thickness direction may be no less than half the plate thickness of the part of the burner cylinder-forming plate where the tapered surface is not formed.

According to this combustor, the tapered surface is formed in the downstream end portion of the burner cylinder, and furthermore, the tapered surface formation width, in the plate thickness direction, of the tapered surface including the outer tapered surface and the inner tapered surface is no less than half the plate thickness of the part of the burner cylinder-forming plate where the tapered surface is not formed. As such, according to this combustor, the possibility of flames forming near the downstream end of the burner cylinder can be reduced.

Here, in the combustor in which the outer tapered surface and the inner tapered surface are formed, the tapered surface formation width of the outer tapered surface in the plate thickness direction may be greater than the taper formation width of the inner tapered surface in the plate thickness direction.

On the downstream side of the downstream end of the burner cylinder in this combustor, the flow of the air flowing along the outer tapered surface has greater influence than the flow of the gas containing the fuel flowing along the inner tapered surface. As such, according to this combustor, a situation in which the gas containing the fuel jetted from the burner cylinder spreads out in radial directions relative to the burner axis can be suppressed.

Additionally, in the combustor according to the above-described aspect, an inner tapered surface may be formed in an inner circumferential side of the burner cylinder as the tapered surface, and a taper formation width of the inner tapered surface in the plate thickness direction may be no less than half the plate thickness of the part of the burner cylinder-forming plate where the tapered surface is not formed.

According to this combustor as well, the tapered surface is formed in the downstream end portion of the burner cylinder, and furthermore, the tapered surface formation width of the inner tapered surface in the plate thickness direction is no less than half the plate thickness of the part of the burner cylinder-forming plate where the inner tapered surface is not formed. As such, according to tins combustor, the possibility of flames forming near the downstream end of the burner cylinder can be reduced.

In any of the above-described combustors in which the outer tapered surface is formed, the combustor may include a plurality of burners, each having the nozzle and the burner cylinder. Here, the burner axes of the plurality of burners may be parallel to each other; at least a first outer circumference portion that is a part of the outer circumference of the burner cylinder of a first burner that is one of the plurality of burners may face a part of an inner circumference of the outside flow path cylinder such that a first purge air flow path serving as the purge air flow path is formed between the first outer circumference portion and the part of the inner circumference of the outside flow path cylinder; a second purge air flow path in which air flows toward the downstream side may be formed between a part of an outer circumference of the burner cylinder of a second burner that, of the plurality of burners, is adjacent to the first burner, and a second outer circumference portion that is a part of the outer circumference of the burner cylinder of the first burner; and an angle of the outer tapered surface in the second outer circumference portion relative to the burner axis may be greater than an angle of the outer tapered surface in the first outer circumference portion relative to the burner axis.

To suppress disturbances in the flow of gas flowing along the inner and outer circumferences of the burner cylinder and reduce gas flow resistance, it is preferable that the angle of the tapered surface relative to the burner axis be small. However, according to this combustor, the angle of the outer tapered surface in the second outer circumference portion relative to the burner axis is greater than the angle of the outer tapered surface in the first outer circumference portion relative to the burner axis. Furthermore, according to this combustor, the second burner is adjacent to the second outer circumference portion of the first burner. Accordingly, if the gas containing the fuel, which has flowed along the inner circumferential side of the first burner cylinder, is floating near the downstream end of the part where the second outer circumference portion is formed in the downstream end portion of the first burner cylinder, it is possible that the fuel will ignite near that downstream end. However, according to this combustor, although doing so does slightly increase the resistance to the flow of gas flowing in the inner and outer circumferences of the first burner cylinder, the angle of the outer tapered surface formed in the second outer circumference portion relative to the burner axis is made greater than the angle of the outer tapered surface formed in the first outer circumference portion relative to the burner axis in order to ensure that the gas containing the fuel jetted from the first burner cylinder moves away from the adjacent second burner.

In the combustor including the first burner and the second burner, the first burner may be a premixed combustion burner that burns fuel jetted from the burner cylinder of the first burner through premixed combustion; the second burner may be a diffusion combustion burner that burns fuel jetted from the burner cylinder of the second burner through diffusion combustion; a plurality of the first burners may be arranged in a circumferential direction centered on the second burner; and the outside flow path cylinder may have a cylindrical shape centered on the second burner so as to cover the plurality of first burners.

Additionally, in any of the above-described combustors, a tapered surface may be formed in a downstream end portion of the outside flow path cylinder such that a plate thickness of an outside flow path cylinder-forming plate that forms the outside flow path cylinder gradually thins as the outside flow path cylinder-forming plate extends toward the downstream side, and a tapered surface formation width of the tapered surface in the plate thickness direction may be no less than half the plate thickness of the outside flow path cylinder-forming plate.

According to this combustor, resistance to the flow of air flowing in the purge air flow path can be suppressed.

According to an aspect of the present invention for achieving the above-described object, a gas turbine includes:

any one of the above-described combustors; a compressor that compresses air and supplies the air to the combustor; and a turbine that is driven by combustion gas formed by burning a fuel in the combustor.

Advantageous Effects of Invention

According to an aspect of the present invention, thermal damage and the like in a burner cylinder can be suppressed and the service life of a combustor can be extended.

DESCRIPTION OF EMBODIMENTS

An embodiment of a gas turbine according to the present invention, and several modified examples of a combustor included in the gas turbine, will be described below in detail with reference to the drawings.

Embodiment

Figure 1:
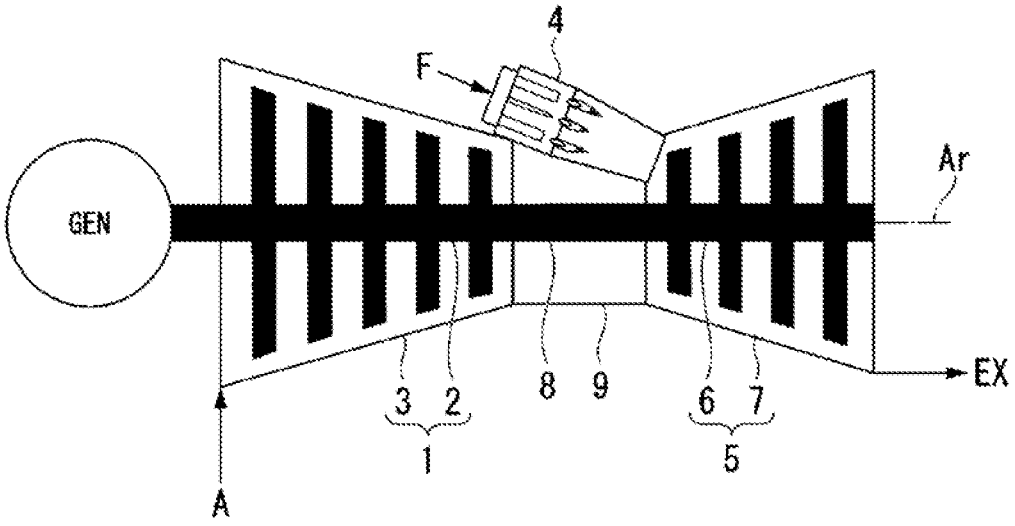
FIG. 1 is a schematic view illustrating the configuration of a gas turbine according to an embodiment of the present invention.

As illustrated in FIG. 1, a gas turbine according to the present embodiment includes a compressor 1 that generates compressed air by compressing outside air, a plurality of combustors 4 that generate a combustion gas by burning fuel F in the compressed air, and a turbine 5 driven by the combustion gas.

The compressor 1 has a compressor rotor 2 that rotates about a rotational axis Ar and a compressor casing 3 that covers the compressor rotor 2 while allowing the compressor rotor 2 to rotate. The turbine 5 has a turbine rotor 6 that rotates about a rotational axis Ar and a turbine casing 7 that covers the turbine rotor 6 while allowing the turbine rotor 6 to rotate. The rotational axis Ar of the compressor rotor 2 and the rotational axis Ar of the turbine rotor 6 are located on the same straight line. The compressor rotor 2 and the turbine rotor 6 are connected with each other to form a gas turbine rotor 8. Meanwhile, the compressor casing 3 and the turbine casing 7 are connected with each other to form a gas turbine casing 9.

A generator rotor, for example, is connected to the gas turbine rotor 8. Furthermore, the combustors 4 are fixed to the gas turbine casing 9.

Figure 2:
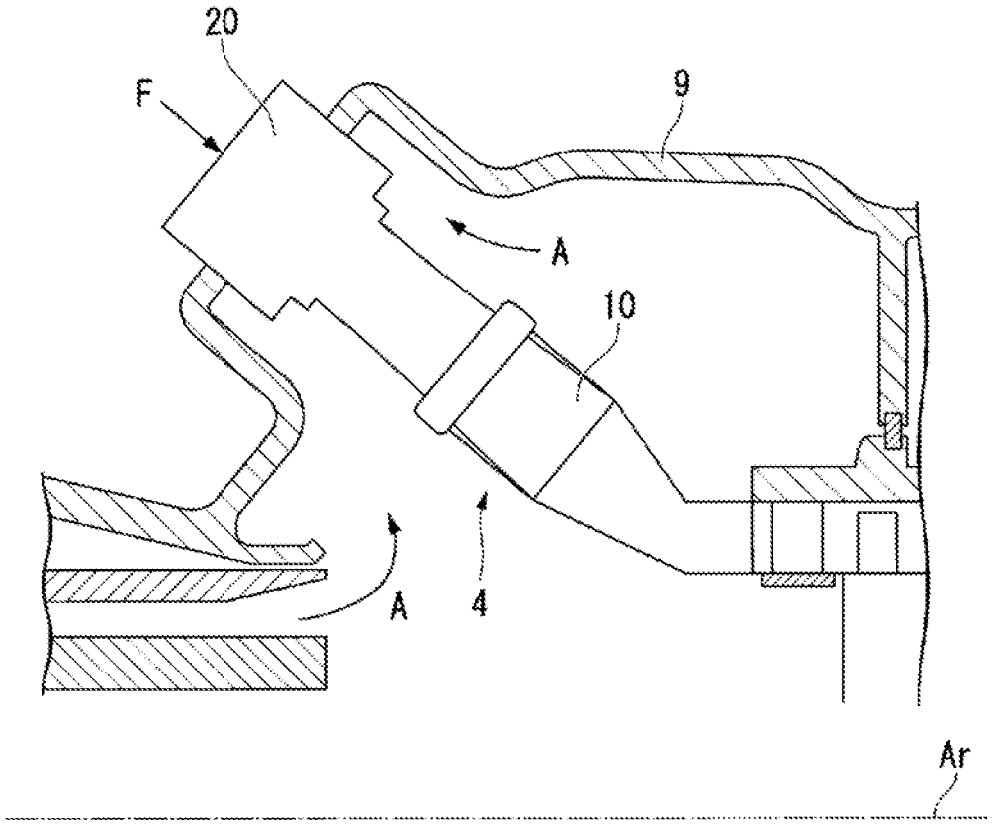
FIG. 2 is a cross-sectional view of the vicinity of a combustor in the gas turbine according to the embodiment of the present invention.

As illustrated in FIG. 2, each combustor 4 includes a combustion liner (or transition piece) 10 and a fuel jetting device 20. The fuel F is burned inside the combustion liner 10, and the combustion gas generated by burning the fuel F is guided to the turbine 5. The fuel jetting device 20 jets the fuel F and air A into the combustion liner 10.

Figure 3:
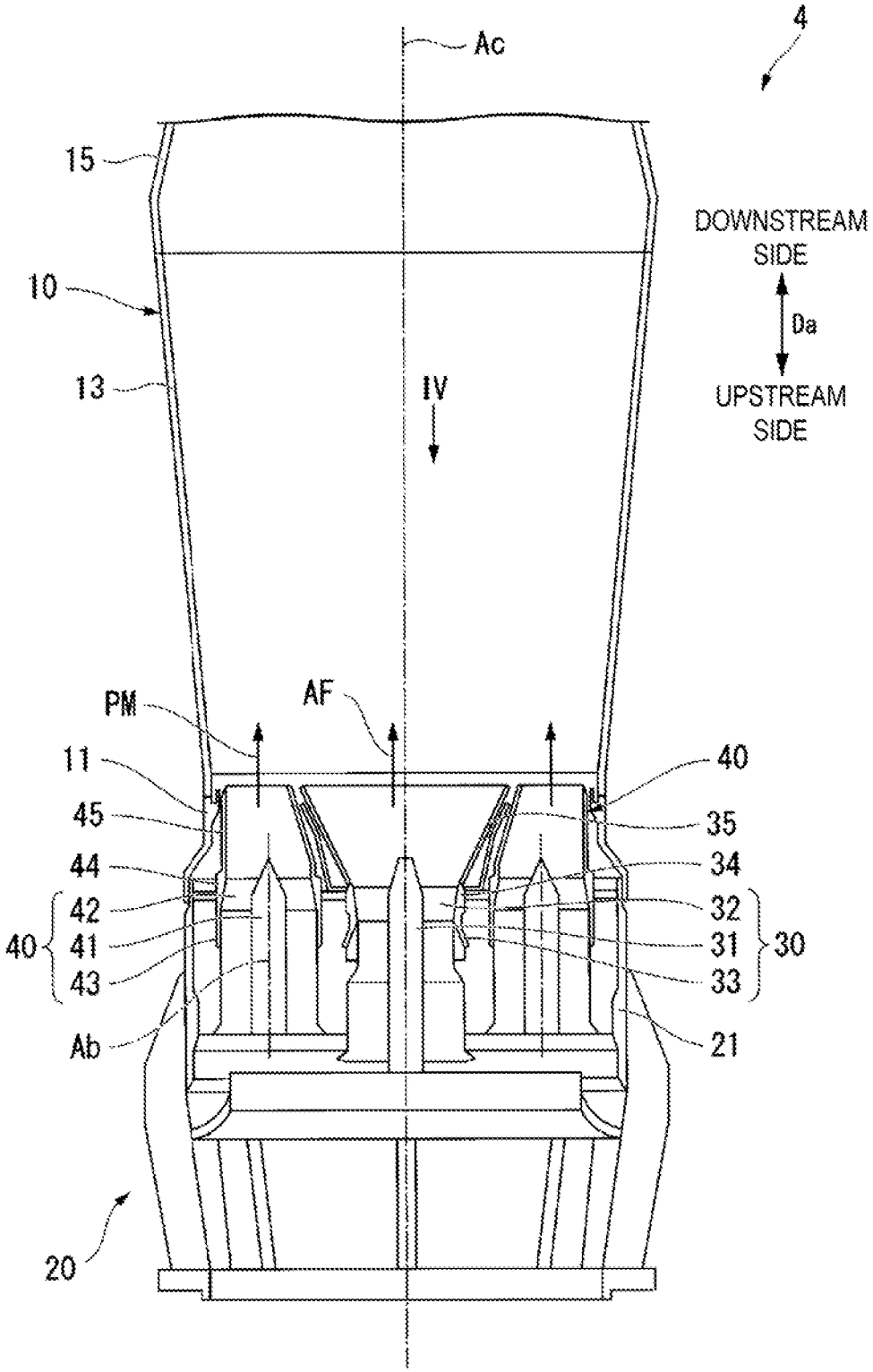
FIG. 3 is a cross-sectional view illustrating the combustor according to the embodiment of the present invention.

As illustrated in FIG. 3, the fuel jetting device 20 includes: a pilot burner (second burner or diffusion combustion burner) 30 that burns the jetted fuel through diffusion combustion; main burners (first burners or premixed combustion burners) 40 that burn the jetted fuel through premixed combustion; and a burner holding cylinder 21 that holds the pilot burner 30 and the main burners 40.

The pilot burner 30 includes: a rod-shaped pilot nozzle 31 centered on a combustor axis Ac and extending in an axial direction Da; a pilot burner cylinder 33 that covers the outer circumference of the pilot nozzle 31; and a plurality of revolving plates 32 that cause the compressed air to swirl around the combustor axis Ac. Here, one side in the axial direction Da, which is the direction in which the combustor axis Ac extends, will be referred to as an upstream side, and the other side in the axial direction Da will be referred to as a downstream side. The combustor axis Ac is also a burner axis of the pilot burner 30.

A spraying hole for spraying the fuel is formed in a downstream side end of the pilot nozzle 31. The plurality of revolving plates 32 are provided downstream from the location where the spraying hole is formed in the pilot nozzle 31. Each revolving plate 32 extends from the outer circumference of the pilot nozzle 31 in a direction including a radial direction component, and is connected to an inner circumferential surface of the pilot burner cylinder 33. The pilot burner cylinder 33 includes a main portion 34 located on the outer circumference of the pilot nozzle 31, and a cone portion 35 that is connected to a downstream side of the main portion 34 and gradually flares outward as the cone portion 35 extends in the downstream direction. The plurality of revolving plates 32 are connected to an inner circumferential surface of the main portion 34 in the pilot burner cylinder 33. The compressed air compressed by the compressor 1 flows into the pilot burner cylinder 33 from the upstream side thereof. The pilot burner cylinder 33 jets the fuel sprayed from the pilot nozzle 31, along with the compressed air, from a downstream end thereof. This fuel is burned in the combustion liner 10 through diffusion combustion.

Figure 4:
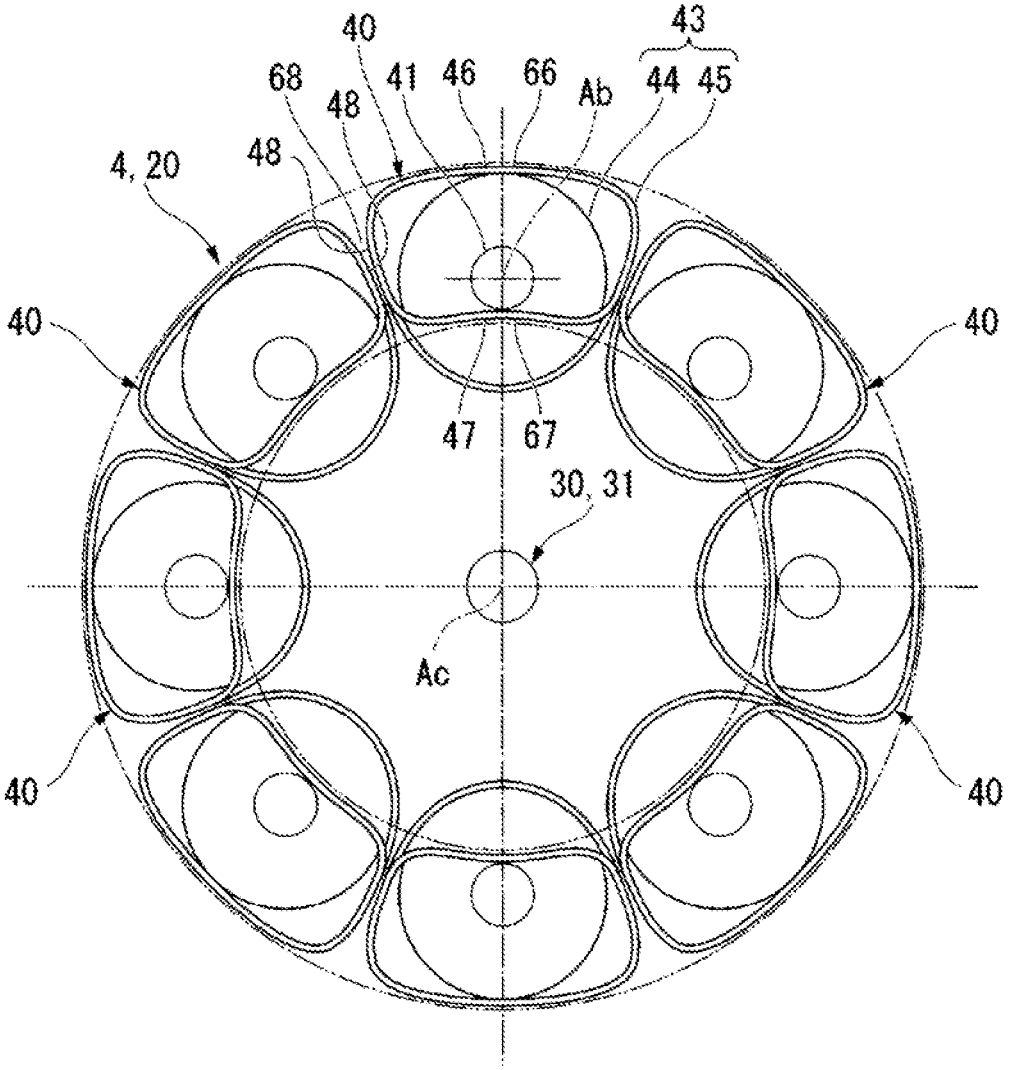
FIG. 4 is a view taken from the arrow IV indicated in FIG. 3.

As illustrated in FIG. 4, the plurality of main burners 40 are arranged in a circumferential direction, centered on to the combustor axis Ac, so as to surround the outer circumferential side of the pilot burner 30.

Figure 5:
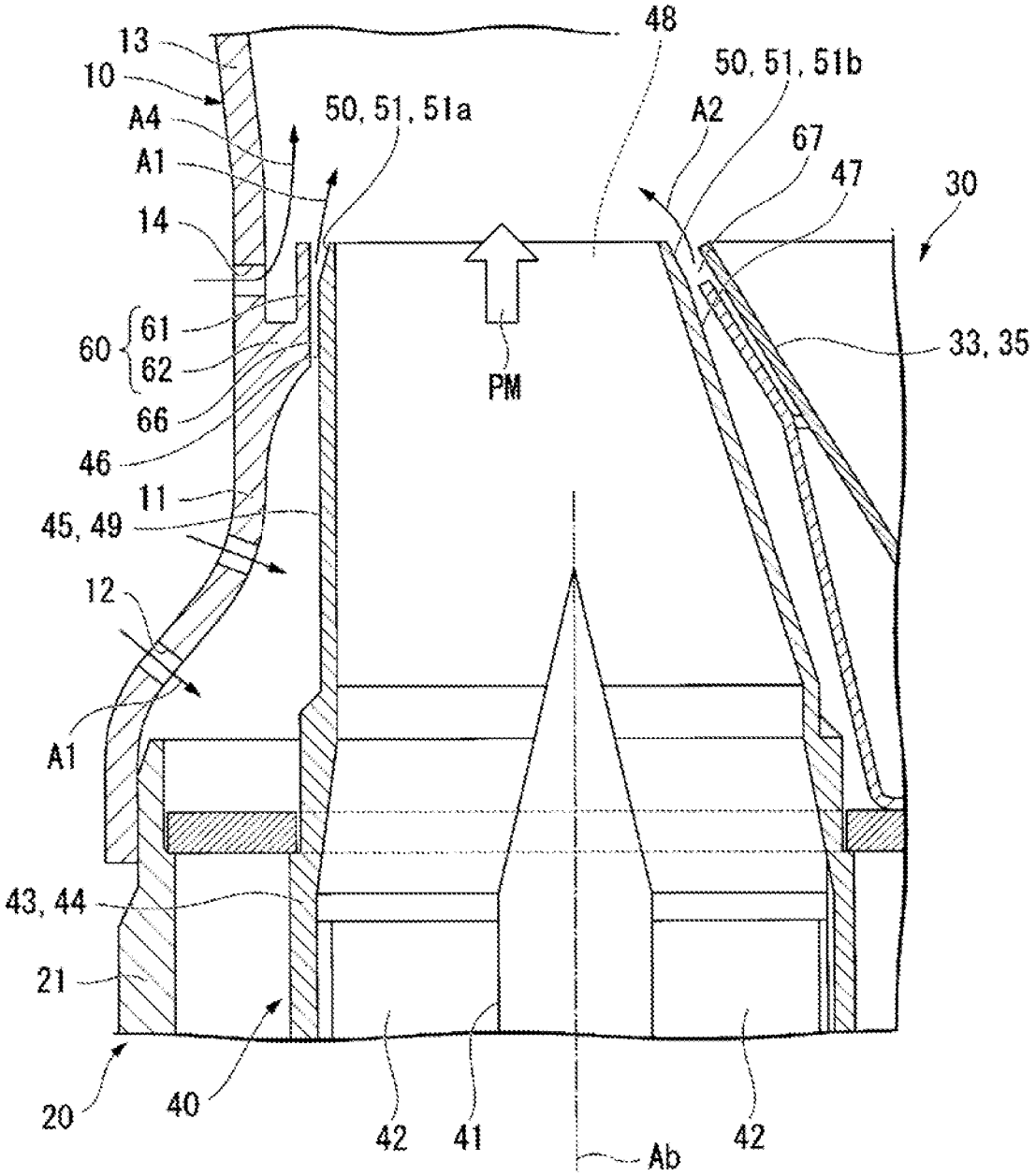
FIG. 5 is a cross-sectional view of the vicinity of a main burner according to the embodiment of the present invention.

As illustrated in FIGS. 3 and 5, each main burner 40 includes: a rod-shaped main nozzle 41, centered on a burner axis Ab parallel to the combustor axis Ac, and extending in the axial direction Da; a main burner cylinder 43 that covers the outer circumference of the main nozzle 41; and a plurality of revolving plates 42 that cause the compressed air to swirl around the burner axis Ab. Because the burner axis Ab of the main burner 40 is parallel to the combustor axis Ac, the axial direction Da relative to the combustor axis Ac is the same direction as the axial direction Da relative to the burner axis Ab. Likewise, the upstream side in the axial direction Da relative to the combustor axis Ac corresponds to the upstream side in the axial direction Da relative to the burner axis Ab, and the downstream side in the axial direction Da relative to the combustor axis Ac corresponds to the downstream side in the axial direction Da relative to the burner axis Ab.

A spraying hole for spraying the fuel is formed in a part midway along the main nozzle 41 in the axial direction Da. The plurality of revolving plates 42 are provided near the location where the spraying hole is formed in the main nozzle 41. Each revolving plate 42 extends from the outer circumference of the main nozzle 41 in a direction including a radial direction component, and is connected to an inner circumferential surface of the main burner cylinder 43. The main burner cylinder 43 includes a main portion 44 located on the outer circumference of the main nozzle 41, and an extended portion 45 that is connected to a downstream side of the main portion 44 and extends in the downstream direction. The plurality of revolving plates 42 are connected to an inner circumferential surface of the main portion 44 in the main burner cylinder 43. The compressed air compressed by the compressor 1 flows into the main burner cylinder 43 from the upstream side thereof. In the main burner cylinder 43, the compressed air and the fuel sprayed from the main nozzle 41 are mixed to form a premixed gas PM. The main burner cylinder 43 jets the premixed gas PM from the downstream end thereof. The fuel in the premixed gas PM is burned through premixed combustion in the combustion liner 10.

Here, a spraying hole for spraying the fuel may be formed in the revolving plates 42, and the fuel may be sprayed into the main burner cylinder 43 from this spraying hole. In this case, the part corresponding to the rod-shaped main nozzle 41 described above constitutes a hub rod, and the main nozzle is formed including this hub rod and the plurality of revolving plates 42. Fuel is supplied into the hub rod from the exterior, and the fuel is supplied from the hub rod to the revolving plates 42.

As illustrated in FIG. 4, the main portion 44 of the main burner cylinder 43 has a circular shape when viewed from the axial direction Da. Meanwhile, when viewed from the axial direction Da, the extended portion 45 of the main burner cylinder 43 has an arch shape formed by a large circular arc centered on the combustor axis Ac, a small circular are located further toward the combustor axis Ac than the large circular arc and centered on the combustor axis Ac, and connection lines extending in a radial direction relative to the combustor axis Ac and linearly connecting ends of the large circular arc to corresponding ends of the small circular arc. Of the outer circumference of the extended portion 45, a portion corresponding to the large circular arc constitutes a first outer circumference portion 46, a portion corresponding to the small circular arc constitutes a second outer circumference portion 47, and portions corresponding to the connection lines constitute third outer circumference portions 48.

As illustrated in FIGS. 3 and 5, the burner holding cylinder 21 has a cylindrical shape centered on the combustor axis Ac and covers the outer circumferential side of the main portions 44 of the plurality of main burner cylinders 43.

The combustion liner 10 includes: a connecting portion 11 on an inner circumferential side of which the extended portions 45 of the plurality of main burner cylinder 43 are located; a combustion portion 13 forming a fuel region in which the fuel jetted from the main burners 40 and the pilot burner 30 is burned; and a combustion gas guide portion 15 that glides the combustion gas generated by burning the fuel to the turbine 5. Both the connecting portion 11 and the combustion portion 13 have a cylindrical shape centered on the combustor axis Ac. The combustion gas guide portion 15 has a tubular shape. An upstream end of the connecting portion 11 of the combustion liner 10 is connected to the burner holding cylinder 21. The combustion portion 13 of the combustion liner 10 is formed on the downstream side of the connecting portion 11 of the combustion liner 10. The combustion gas guide portion 15 of the combustion liner 10 is formed on the downstream side of the combustion portion 13 of the combustion liner 10.

A connecting portion air hole 12 is formed in the cylindrical connecting portion 11 passing therethrough from the outer circumferential side to the inner circumferential side, so as to guide the compressed air from the compressor 1 as first purge air A1 to the inner circumferential side. An outside flow path cylinder 60 is disposed in the vicinity of a boundary between the connecting portion 11 and the combustion portion 13 of the combustion liner 10, the outside flow path cylinder 60 forming a first purge air flow path 66 between the outer circumferential sides of the plurality of main burners 40 and the inner circumferential side of the outside flow path cylinder 60 on the inner circumferential side of that boundary. The outside flow path cylinder 60 includes a cylindrical main portion 61 centered on the combustor axis Ac and a connecting portion 62 extending from a downstream side of the main portion 61 toward the outer circumferential side and connected to the combustion liner 10. A film air hole 14 is formed in a part of the combustion liner 10 opposing the main portion 61 of the outside flow path cylinder 60, passing through the combustion liner 10 from the outer circumferential side to the inner circumferential side, so as to guide the compressed air from the compressor 1 as film air A4 to the inner circumferential side. The aforementioned first purge air flow path 66, in which the first purge air A1 flows from the upstream side to the downstream side, is formed between the inner circumferential side of the main portion 61 of the outside flow path cylinder 60 and the first outer circumference portions 46 of the extended portions 45 of the plurality of main burner cylinders 43.

A second purge air flow path 67, in which second purge air A2 flows from the upstream side to the downstream side, is formed between the second outer circumference portions 47 of the extended portions 45 of the plurality of main burner cylinders 43 and the outer circumference of the cone portion 35 of the pilot burner cylinder 33.

Additionally, as illustrated in FIG. 4, a third purge air flow path 68 through which third purge air flows from the upstream side to the downstream side is formed between the third outer circumference portions 48 of the extended portions 45 of the main burner cylinders 43 adjacent to each other in a circumferential direction centered on the combustor axis Ac. The third purge air and the aforementioned second purge air A2 are both compressed air that has been compressed by the compressor 1 and has flowed into the inner circumferential side of the burner holding cylinder 21.

Figure 6:
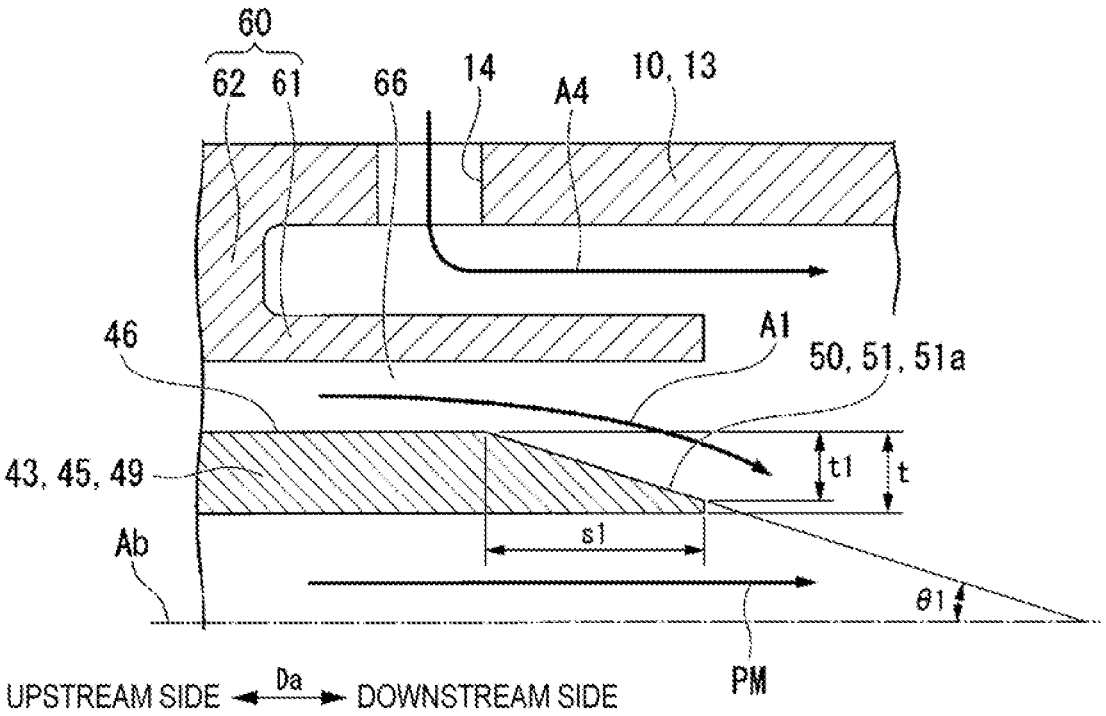
FIG. 6 is a cross-sectional view of the vicinity of a first outer circumference portion of a main burner cylinder according to the embodiment of the present invention.
Figure 7:
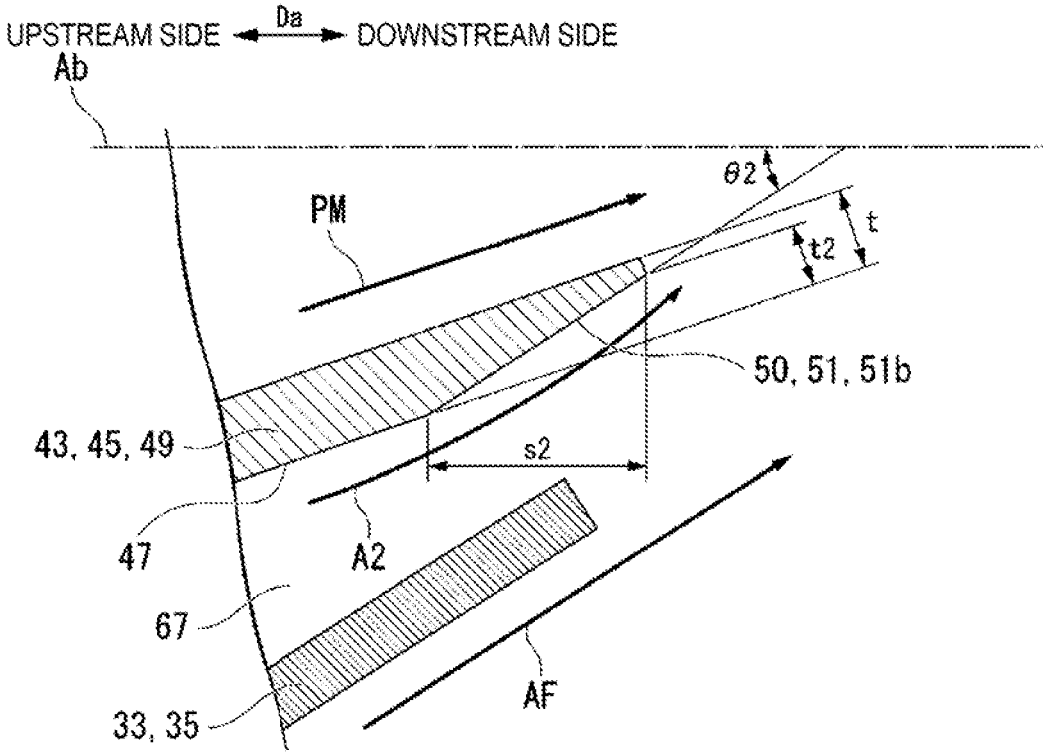
FIG. 7 is a cross-sectional view of the vicinity of a second outer circumference portion of the main burner cylinder according to the embodiment of the present invention.

As illustrated in FIGS. 6 and 7, a tapered surface 50 is formed in the downstream end portion of the main burner cylinder 43 such that the plate thickness of a burner cylinder-forming plate 49 that forms the main burner cylinder 43 gradually thins as the burner cylinder-forming plate 49 extends toward the downstream side. This tapered surface 50 is an outer tapered surface 51, formed in the outer circumferential side of the main burner cylinder 43, that slopes so as to gradually approach the inner circumferential surface of the main burner cylinder 43 as the outer tapered surface extends toward the downstream side. The outer tapered surface 51 is formed across the entire outer circumference of the main burner cylinder 43. As such, the outer tapered surface 51 includes an outer tapered surface 51*a* formed in the first outer circumference portion 46 of the main burner cylinder 43, as illustrated in FIG. 6, and an outer tapered surface 51*b* formed in the second outer circumference portion 47 of the main burner cylinder 43, as illustrated in FIG. 7. The outer tapered surface 51 also includes an outer tapered surface (not illustrated) formed in the third outer circumference surface of the main burner cylinder 43.

As illustrated in FIG. 6, a tapered surface formation width t1 of the outer tapered surface 51*a* formed in the first outer circumference portion 46, in a plate thickness direction, is no less than half a plate thickness t of a part of the burner cylinder-forming plate 49 where the outer tapered surface 51*a* is not formed. More preferably, the tapered surface formation width t1 of the outer tapered surface 51*a* formed in the first outer circumference portion 46, in the plate thickness direction, is no less than 60% of the plate thickness t of the part of the burner cylinder-forming plate 49 where the outer tapered surface 51*a* is not formed. Note that the plate thickness t serving as a reference, mentioned above, is the plate thickness of a furthest downstream part in the part of the burner cylinder-forming plate 49 where the outer tapered surface 51*a* is not formed.

A tapered surface formation length s1 of the outer tapered surface 51*a* formed in the first outer circumference portion 46, in the axial direction Da, is longer than the aforementioned tapered surface formation width t1.

An angle θ1 of the outer tapered surface 51*a* formed in the first outer circumference portion 46 relative to the burner axis Ab is no greater than 50° and no less than 20° (50°≥θ1≥20°). Here, the inner circumferential surface and the outer circumferential surface of the burner cylinder-forming plate 49 at the part thereof where the first outer circumference portion 46 is formed are both parallel to the burner axis Ab. Accordingly, the angles of the outer tapered surface 51*a* relative to the inner circumferential surface and the outer circumferential surface of the burner cylinder-forming plate 49 at the outer tapered surface 51*a* are also no greater than 50° and no less than 20°. Here, the angle θ1 of the outer tapered surface 51*a* relative to the burner axis Ab is an angle in a virtual plane that contains the burner axis Ab and intersects with the outer tapered surface 51*a*. Hereinafter, the angles of the tapered surface 50 relative to the burner axis Ab are angles in a virtual plane that contains the burner axis Ab and intersects with the tapered surface 50.

Meanwhile, as illustrated in FIG. 7, a tapered surface formation width t2 of the outer tapered surface 51*b* formed in the second outer circumference portion 47, in the plate thickness direction, is no less than half the plate thickness t of a part of the burner cylinder-forming plate 40 where the outer tapered surface 51*b* is not formed. More preferably, the tapered surface formation width t2 of the outer tapered surface 51*b* formed in the second outer circumference portion 47, in the plate thickness direction, is no less than 60% of the plate thickness t of the part of the burner cylinder-forming plate 49 where the outer tapered surface 51*b* is not formed.

A tapered surface formation length s2 of the outer tapered surface 51*b* formed in the second outer circumference portion 47, in the axial direction Da, is no less than the aforementioned tapered surface formation width t2. Here, from the standpoint of the ease of processing, the tapered surface formation length s2 of the outer tapered surface 51*b* formed in the second outer circumference portion 47, in the axial direction Da, is the same length as the tapered surface formation length s1 of the outer tapered surface 51*a* formed in the first outer circumference portion 46, in the axial direction Da.

An angle θ2 of the outer tapered surface 51*b* formed in the second outer circumference portion 47 relative to the burner axis Ab is greater than the angle θ1 of the outer tapered surface 51*a* formed in the first outer circumference portion 46 relative to the burner axis Ab. Preferably, the angle θ2 is no greater than 70° and no less than 30° (70°≥θ2≥30°).

Additionally, although not illustrated, a tapered surface formation width of the outer tapered surface 51 formed in the third outer circumference portion 48, in a plate thickness direction, is also no less than half the plate thickness t of the part of the burner cylinder-forming plate 49 where the outer tapered surface 51 is not formed. More preferably, the tapered surface formation width of the outer tapered surface 51 formed in the third outer circumference portion 48, in the plate thickness direction, is also no less than 60% of the plate thickness t of the part of the burner cylinder-forming plate 49 where the outer tapered surface 51 is not formed. The angle of the outer tapered surface 51 formed in the third outer circumference portion 48 relative to the burner axis Ab is no greater than 50° and no less than 20°.

Figure 8:
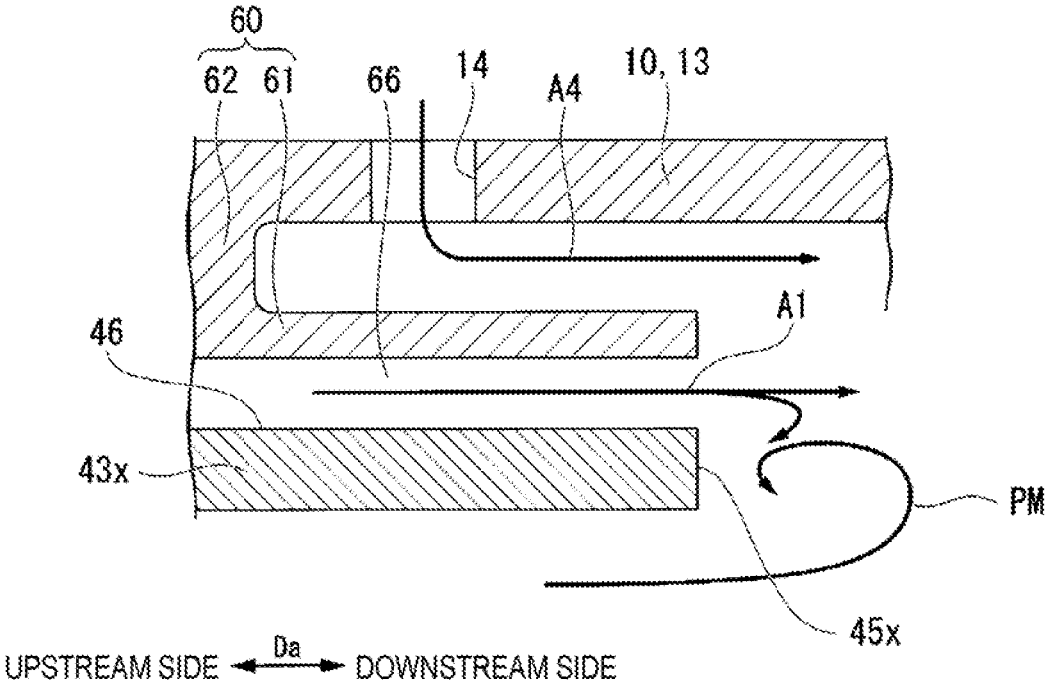
FIG. 8 is a cross-sectional view of the vicinity of a first outer circumference portion of a main burner cylinder according to a comparative example.

The flow of a gas in the vicinity of a downstream end portion of a main burner cylinder 43*x* according to a comparative example in which a tapered surface is not formed in the downstream end portion of the main burner cylinder 43*x* will be described next using FIG. 8.

In the case where a tapered surface is not formed in the downstream end portion of the main burner cylinder 43*x*, a downstream end surface 45*x* of the main burner cylinder 43*x* is a flat surface perpendicular to the inner circumferential surface and the outer circumferential surface of the main burner cylinder 43*x*. In this case, on the downstream side of the downstream end surface 45*x* of the main burner cylinder 43*x*, the premixed gas PM flowing from the main burner cylinder 43*x* forms a vortex, and the first purse air A1 flowing from the first purge air flow path 66 formed on the outer circumferential side of the first outer circumference portion 46 of the main burner cylinder 43*x* forms a vortex.

When the premixed gas PM and the first purge air A1 form vortices on the downstream side of the downstream end surface 45*x* of the main burner cylinder 43*x* in this manner, there is an increased possibility of flames forming near the downstream end surface 45*x* of the main burner cylinder 43*x*. Thus, according to the comparative example, flames may form near the downstream end surface 45*x* of the main burner cylinder 43*x* depending on the operating state of the combustor. As such, according to the comparative example, the downstream end portion of the main burner cylinder 43*x* will be put in a high-temperature environment, which subjects the main burner cylinder 43*x* to thermal damage and shortens the service life of the main burner cylinder 43*x*.

On the other hand, in the present embodiment, the outer tapered surface 51 is formed across the entire outer circumference of the main burner cylinder 43 in the downstream end portion of the main burner cylinder 43 as described earlier. Thus, according to the present embodiment, it is difficult for the premixed gas PM and the first purge air A1 to form vortices on the downstream side of the downstream end of the main burner cylinder 43. As such, according to the present embodiment, the possibility of flames forming near the downstream end of the main burner cylinder 43 can be reduced. Thus, according to the present embodiment, thermal damage and the like in the main burner cylinder 43 can be suppressed and the service life of the main burner cylinder 43 can be extended more than is possible with the comparative example.

Incidentally, forming even a slight tapered surface 50 in the downstream end portion of the main burner cylinder 43 makes it possible to achieve the effect of suppressing vortices to at least a small degree. However, it becomes easier for the premixed gas PM and the first purge air A1 to form vortices on the downstream side of the downstream end of the main burner cylinder 43 when the tapered surface formation width of the tapered surface 50 in the plate thickness direction is less than half the plate thickness t of the part of the burner cylinder-forming plate 49 where the tapered surface 50 is not formed. Furthermore, these vortices increase the possibility of flames forming near the downstream end of the main burner cylinder 43.

As opposed to this, when the tapered surface formation width of the tapered surface 50 in the plate thickness direction is no less than half the plate thickness t of the part of the burner cylinder-forming plate 49 where the tapered surface 50 is not formed, the premixed gas PM and the first purge an A1 will substantially not form vortices on the downstream side of the downstream end of the main burner cylinder 43; or, even if such vortices are formed, those vortices will be small. In the case where, for example, the tapered surface formation width of the tapered surface 50 in the plate thickness direction is 60% of the plate thickness t of the part of the burner cylinder-forming plate 49 where the tapered surface 50 is not formed, there is a possibility of the premixed gas PM and the first purge air A1 forming small vortices on the downstream side of the downstream end of the main burner cylinder 43. However, with such small vortices, it can be said that there is substantially no possibility of flames forming near the downstream end of the main burner cylinder 43. Thus, according to the present embodiment, the tapered surface formation width of the tapered surface 50 in the plate thickness direction is set to no less than half the plate thickness t of the part of the burner cylinder-forming plate 49 where the tapered surface 50 is not formed.

Additionally, according to the present embodiment, the outer tapered surface 51, which is formed in the outer circumferential side of the main burner cylinder 43 and slopes so as to gradually approach the inner circumferential surface of the main burner cylinder 43 as the outer tapered surface extends toward the downstream side, is employed as the tapered surface 50. This makes it possible to suppress a situation in which the premixed gas PM jetted from the main burner cylinder 43 spreads out in radial directions relative to the burner axis Ab. Thus, premixed flame separates from the inner circumferential surface of the combustion liner 10, so that damage to the combustion liner 10 can be suppressed.

To suppress disturbances in the flow of gas flowing along the inner and outer circumferences of the pilot burner cylinder 33 and reduce gas flow resistance, it is preferable that the angle of the tapered surface 50 relative to the burner axis Ab be small. However, as described earlier, according to the present embodiment, the angle θ2 of the outer tapered surface 51*b* formed in the second outer circumference portion 47 relative to the burner axis Ab is greater than the angle θ1 of the outer tapered surface 51*a* formed in the first outer circumference portion 46 relative to the burner axis Ab. As illustrated in FIGS. 3 and 7, the pilot burner 30, which jets a gas AF in which fuel and air are not premixed and forms a diffusion flame, is disposed on the side toward the combustor axis Ac of the second outer circumference portion 47 of the main burner cylinder 43. Accordingly, if the premixed gas PM is floating near the downstream end of the part where the second outer circumference portion 47 is formed in the downstream end portion of the main burner cylinder 43, it is possible that the premixed gas PM will ignite near that downstream end. However, according to the present embodiment, although doing so does slightly increase the resistance to the flow of gas flowing in the inner and outer circumferences of the pilot burner cylinder 33, the angle θ2 of the outer tapered surface 51*b* formed in the second outer circumference portion 47 relative to the burner axis Ab is made greater than the angle θ1 of the outer tapered surface 51*a* formed in the first outer circumference portion 46 relative to the burner axis Ab in order to ensure that the premixed gas PM jetted from the main burner cylinder 43 moves away from the pilot burner 30.

Additionally, as illustrated in FIG. 4, other main burner 40 are disposed on the circumferential direction sides of the third outer circumference portions 48 of the main burner cylinders 43 (that is, the circumferential direction centered on the combustor axis Ac). As such, to ensure that the premixed gas PM jetted from the main burner cylinder 43 moves away from the other main burners 40 adjacent in the circumferential direction, it is preferable that the angle of the outer tapered surface 51 formed in the third outer circumference portion 48 relative to the burner axis Ab be greater than the angle θ1 of the outer tapered surface 51*a* formed in the first outer circumference portion 46 relative to the burner axis Ab.

As described thus far, according to the present embodiment, a situation where flames form near the downstream end of the main burner cylinder 43 can be suppressed, which makes it possible to suppress thermal damage and the like in the main burner cylinder 43 and extend the service life of the main burner cylinder 43.

First Modified Example of Combustor

Figure 9:
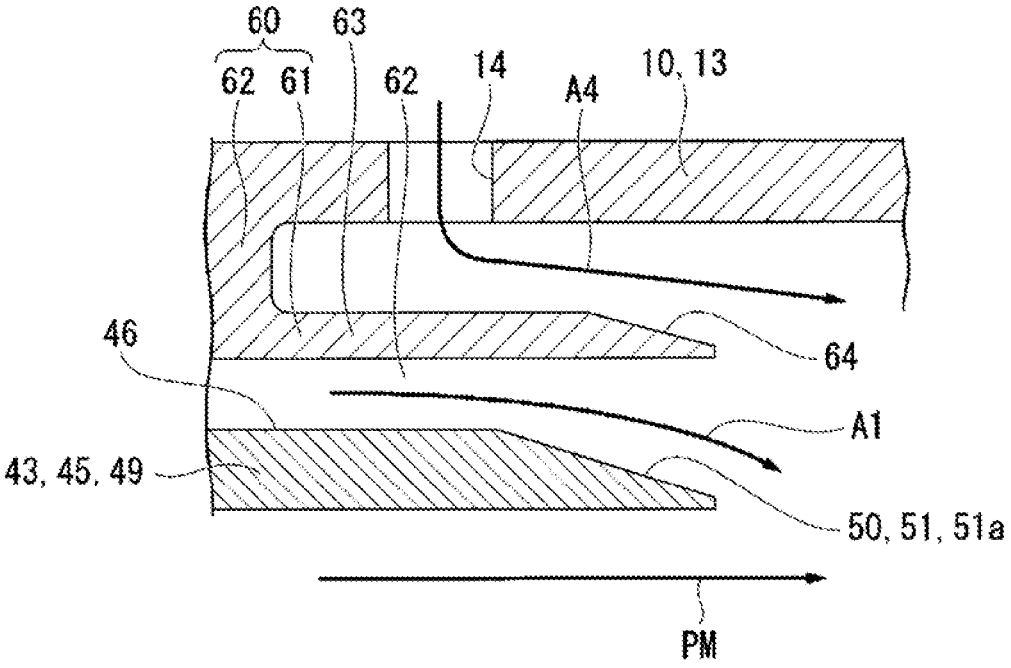
FIG. 9 is a cross-sectional view of the vicinity of a first outer circumference portion of the main burner cylinder according to a first modified example of the present invention.

A first modified example of the combustor according to the embodiment described above will be described using FIG. 9.

The combustor according to the present modified example has the same configuration as the combustor according to the embodiment described above, except that a tapered surface is formed in the downstream end portion of the outside flow path cylinder 60 of the combustor according to the embodiment described above. The tapered surface of the outside flow path cylinder 60 is an outer tapered surface 64, formed in the outer circumferential side of the outside flow path cylinder 60, that slopes so as to gradually approach the inner circumferential surface of the outside flow path cylinder 60 as the outer tapered surface extends toward the downstream side. The tapered surface formation width of the outer tapered surface 64 in the plate thickness direction is no less than half the plate thickness of a part of an outside flow path cylinder-forming plate 63, which forms the main portion 61 of the outside flow path cylinder 60, where the outer tapered surface 64 is not formed.

Thus, according to the present modified example, it is difficult for the first purge air A1 flowing along the inner circumferential side of the outside flow path cylinder 60 and the film air A4 flowing along the outer circumferential side of the outside flow path cylinder 60 to form vortices on the downstream side of the downstream end of the outside flow path cylinder 60. As such, according to the present modified example, resistance to the flow of these airs can be suppressed.

In particular, in the present modified example, the outer tapered surface 64 is formed in the outer circumferential side of the outside flow path cylinder 60 as the tapered surface. As a result, the flow of the film air A4 and the first purge air A1 shifts slightly toward the combustor axis Ac (see FIG. 3), or in other words, moves away from the inner circumferential surface of the combustion liner 10, as those airs flow downstream. Thus, according to the present modified example, of the premixed gas PM jetted from the main burner cylinder 43, the premixed gas PM flowing on the outside flow path cylinder 60 side shifts toward the combustor axis Ac as that gas flows downstream. As such, according to the present modified example, thermal damage and the like at the downstream end of the main burner cylinder 43, at the downstream end of the part thereof where the first outer circumference portion 46 is formed, can be further suppressed, and thermal damage and the like to the inner circumferential surface of the combustion liner 10 can be further suppressed as well.

Second Modified Example of Combustor

Figure 10:
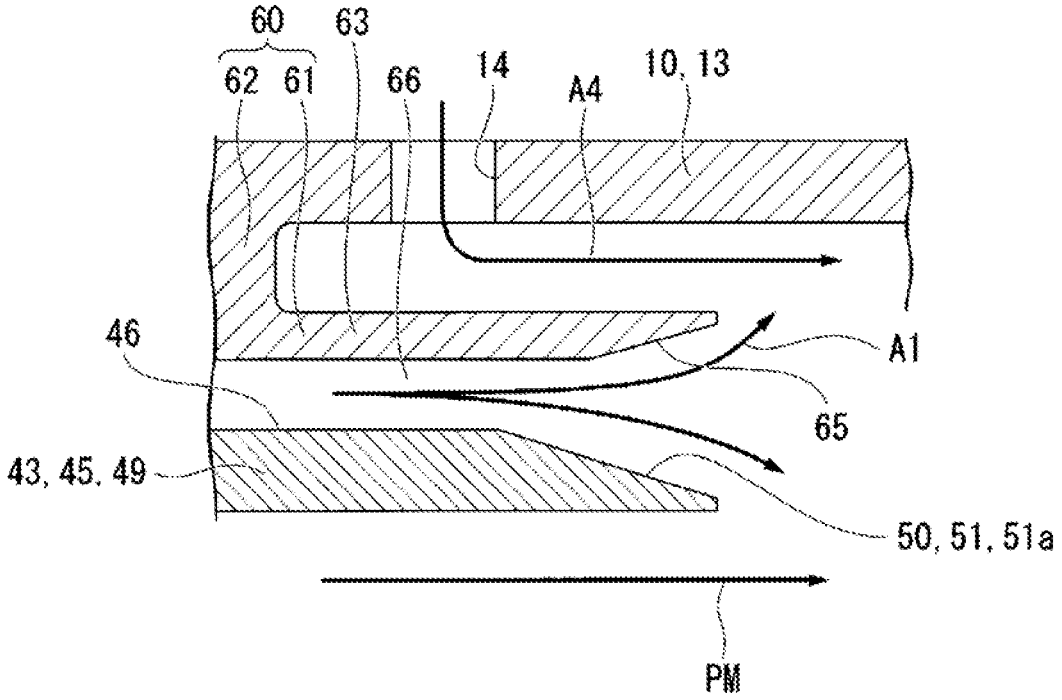
FIG. 10 is a cross-sectional view of the vicinity of a first outer circumference portion of the main burner cylinder according to a second modified example of the present invention.

A second modified example of the combustor according to the embodiment described above will be described using FIG. 10.

Like the combustor according to the first modified example, the combustor according to the present modified example is also obtained by forming a tapered surface in the downstream end portion of the outside flow path cylinder 60 of the combustor according to the embodiment described above. However, the tapered surface of the outside flow path cylinder 60 according to the present modified example is an inner tapered surface 65, formed in the inner circumferential side of the outside flow path cylinder 60, that slopes so as to gradually approach the outer circumferential surface of the outside flow path cylinder 60 as the inner tapered surface extends toward the downstream side. The tapered surface formation width of the inner tapered surface 65 in the plate thickness direction is no less than half the plate thickness of a part of the outside flow path cylinder-forming plate 63, which forms the main portion 61 of the outside flow path cylinder 60, where the inner tapered surface 65 is not formed.

Thus, according to the present modified example, it is difficult for the first purge air A1 flowing along the inner circumferential side of the outside flow path cylinder 60 and the film air A4 flowing along the outer circumferential side of the outside flow path cylinder 60 to form vortices on the downstream side of the downstream end of the outside flow path cylinder 60. As such, according to the present modified example, resistance to the flow of these airs can be suppressed.

Additionally, according to the present modified example, the inner tapered surface 65 is formed in the inner circumferential side of the outside flow path cylinder 60 as the tapered surface. As a result, the flow the film air A4 and some of the first purge air A1 moves slightly away from the combustor axis Ac (see FIG. 3), or in other words, shifts toward the inner circumferential surface of the combustion liner 10, as those airs flow downstream. As such, according to the present modified example, the film air A4 flows along the inner circumferential surface of the combustion liner 10 more than in the above-described embodiment and first modified example, which makes it possible to enhance a film cooling effect in the combustion liner 10.

As described above, different effects are obtained between a case where the outer tapered surface 64 (see FIG. 9) is formed in the outside flow path cylinder 60 and a case where the inner tapered surface 65 is formed in the outside flow path cylinder 60. Accordingly, whether to form the outer tapered surface 64 or the inner tapered surface 65 in the outside flow path cylinder 60 is preferably determined with those different effects weighed against each other.

Third Modified Example of Combustor

Figure 11:
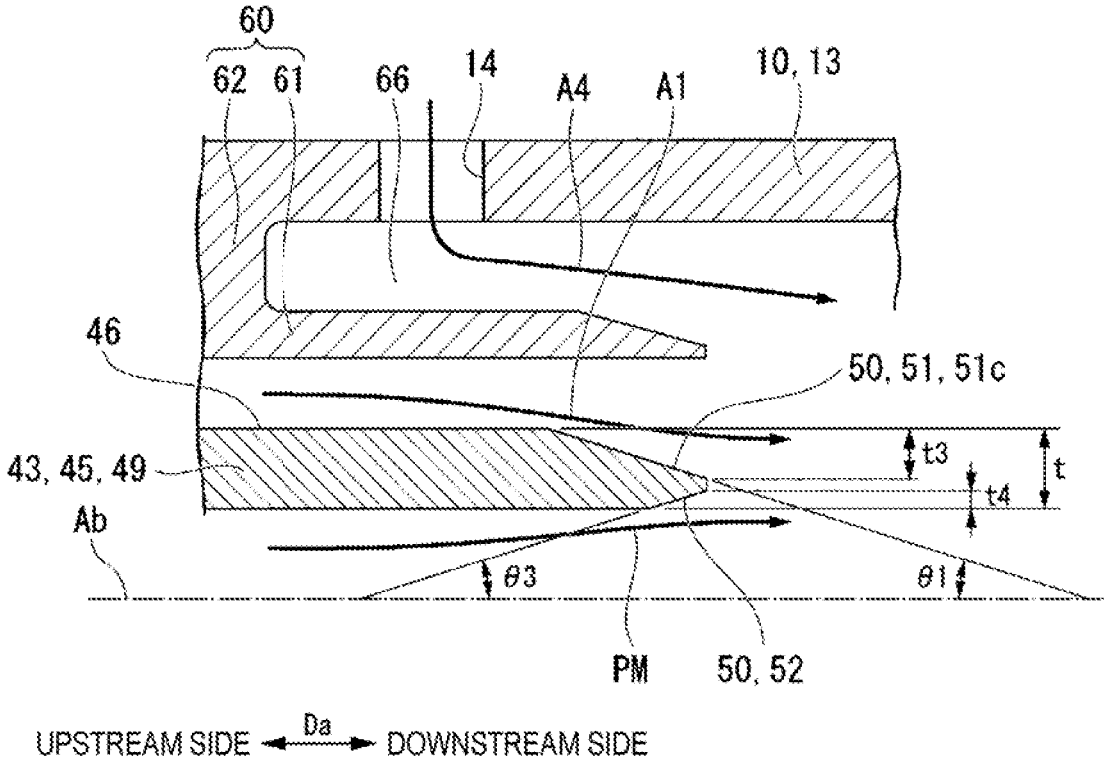
FIG. 11 is a cross-sectional view of the vicinity of a first outer circumference portion of the main burner cylinder according to a third modified example of the present invention.

A third modified example of the combustor according to the embodiment described above will be described using FIG. 11.

In the combustor according to the present modified example, an outer tapered surface 51*c* and an inner tapered surface 52 are formed in the downstream end portion of the main burner cylinder 43. As in the above-described embodiment, the outer tapered surface 51*c* is a surface, formed in the outer circumferential side of the main burner cylinder 43, that slopes so as to gradually approach the inner circumferential surface of the main burner cylinder 43 as the outer tapered surface extends toward the downstream side. The inner tapered surface 52, meanwhile, is a surface, formed in the inner circumferential side of the main burner cylinder 43, that slopes so as to gradually approach the outer circumferential surface of the main burner cylinder 43 as the inner tapered surface extends toward the downstream side.

In the present modified example, a width obtained by combining a tapered surface formation width t3 of the outer tapered surface 51*c* in the plate thickness direction and a tapered surface formation width t4 of the inner tapered surface 52 in the plate thickness direction is no less than half the plate thickness t of a part of the burner cylinder-forming plate 49 where the outer tapered surface 51*c* and the inner tapered surface 52 are not formed. To rephrase, a width of the tapered surface 50, which includes the outer tapered surface 51*c* and the inner tapered surface 52, in the plate thickness direction, is no less than half the plate thickness t of a part where the tapered surface 50 is not formed. More preferably, a tapered surface formation width of the tapered surface 50 including the outer tapered surface 51*c* and the inner tapered surface 52, in the plate thickness direction, is no less than 60% of the plate thickness t of the part of the burner cylinder-forming plate 49 where the tapered surface 50 is not formed. Additionally, the tapered surface formation width t3 of the outer tapered surface 51*c* in the plate thickness direction is greater than the taper formation width t4 of the inner tapered surface 52 in the plate thickness direction.

As in the above-described embodiment, an angle θ1 of the outer tapered surface 51*c* relative to the burner axis Ab is no greater than 50° and no less than 20° (50°≥θ1≥20°). Meanwhile, an angle θ3 of the inner tapered surface 52 relative to the burner axis Ab is also no greater than 50° and no less than 20° (50°≥θ3≥20°). Note that each angle of a surface relative to the axis is one of two angles in a supplementary angle relationship. In this application, the smaller of the two angles in a supplementary angle relationship is taken as the angle of the tapered surface 50 relative to the axis. The angle θ1 of the outer tapered surface 51*c* relative to the burner axis Ab and the angle θ3 of the inner tapered surface 52 relative to the burner axis Ab need not be the same angle.

As described above, according to the present modified example, a width of the tapered surface 50, which is a combination of the outer tapered surface 51*c* and the inner tapered surface 52, in the plate thickness direction, is no less than half the plate thickness t of a part where the tapered surface 50 is not formed, as in the above-described embodiment and modified examples. Accordingly, the premixed gas PM and the first purge air A1 will substantially not form vortices on the downstream side of the downstream end of the main burner cylinder 43, or even if such vortices are formed, those vortices will be small. Thus, according to the present modified example as well, thermal damage and the like in the main burner cylinder 43 can be suppressed and the service life of the main burner cylinder 43 can be extended.

Additionally, according to the present modified example, the tapered surface formation width t3 of the outer tapered surface 51*c* in the plate thickness direction is greater than the taper formation width t4 of the inner tapered surface 52 in the plate thickness direction. Accordingly, on the downstream side of the downstream end of the main burner cylinder 43, the flow of the first purge air A1 flowing along the outer tapered surface 51*c* has greater influence than the flow of the premixed gas PM flowing along the inner tapered surface 52, and thus a situation where the premixed gas PM jetted from the main burner cylinder 43 spreads out in radial directions relative to the burner axis Ab can be suppressed.

Fourth Modified Example of Combustor

Figure 12:
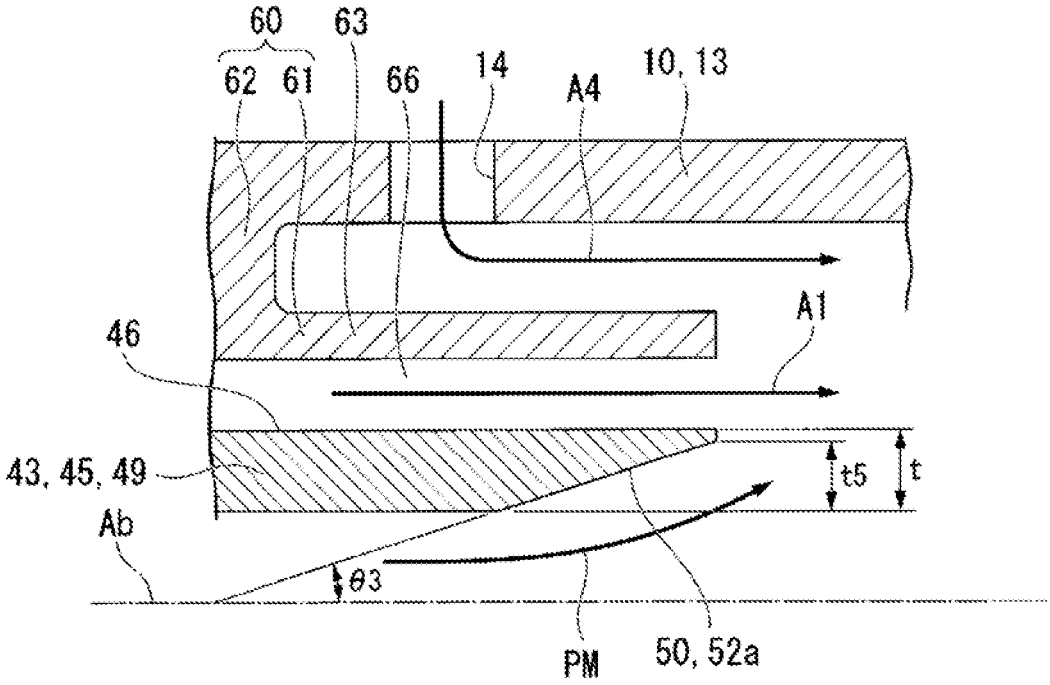
FIG. 12 is a cross-sectional view of the vicinity of a first outer circumference portion of the main burner cylinder according to a fourth modified example of the present invention.

A fourth modified example of the combustor according to the embodiment described above will be described using FIG. 12.

In the combustor according to the present modified example, an inner tapered surface 52*a* is formed in the downstream end portion of the main burner cylinder 43. The inner tapered surface 52*a* is a surface, formed in the inner circumferential side of the main burner cylinder 43, that slopes so as to gradually approach the outer circumferential surface of the main burner cylinder 43 as the inner tapered surface extends toward the downstream side.

In the present modified example, a tapered surface formation width t5 of the inner tapered surface 52*a* in the plate thickness direction is no less than half the plate thickness t of a part of the burner cylinder-forming plate 49 where the inner tapered surface 52*a* is not formed. More preferably, the tapered surface formation width t5 of the inner tapered surface 52*a* in the plate thickness direction is no less than 60% of the plate thickness t of the part of the burner cylinder-forming plate 49 where the inner tapered surface 52*a* is not formed. An angle θ3 of the inner tapered surface 52*a* relative to the burner axis Ab is no greater than 50° and no less than 20° (50°≥θ3≥20°).

In the present modified example, the width t5 of the inner tapered surface 52*a* in the plate thickness direction is no less than half the plate thickness t of the part where the inner tapered surface 52*a* is not formed, as described above. Accordingly, the premixed gas PM and the first purge air A1 will substantially not form vortices on the downstream sure of the downstream end of the main burner cylinder 43, or even if such vortices are formed, those vortices will be small. Thus, according to the present modified example as well, thermal damage and the like in the main burner cylinder 43 can be suppressed and the service life of the main burner cylinder 43 can be extended.

Note that in the present modified example, the inner tapered surface 52*a* is formed as the tapered surface 50, and thus unlike the above-described embodiment and modified examples, the premixed gas PM jetted from the main burner cylinder 43 tends to spread out in radial directions relative to the burner axis Ab. Accordingly, the present modified example may be employed in a case where thermal damage to the inner circumferential surface of the combustion liner 10 can be suppressed even if the premixed gas PM jetted from the main burner cylinder 43 spreads out slightly in radial directions relative to the burner axis Ab, such as in a case where a sufficient effect of cooling such as film cooling can be anticipated for the inner circumferential surface of the combustion liner 10, or a case where there is a long distance from the main burners 40 to the inner circumferential surface of a combustor basket in radial directions centered on the combustor axis Ac (see FIG. 3).

Fifth Modified Example of Combustor

A fifth modified example of the combustor according to the embodiment described above will be described using FIG. 13.

In the above-described embodiment and modified examples, the tapered surfaces have shapes that are straight lines on a virtual plane that contains the axis and intersects with the tapered surfaces. However, as long as the tapered surface is such that the plate thickness of the cylinder-forming plate gradually thins as the cylinder-forming plate extends toward the downstream side, the tapered surface may have a shape that is a curve on the virtual plane that contains the axis and intersects with the tapered surface.

Figure 13:
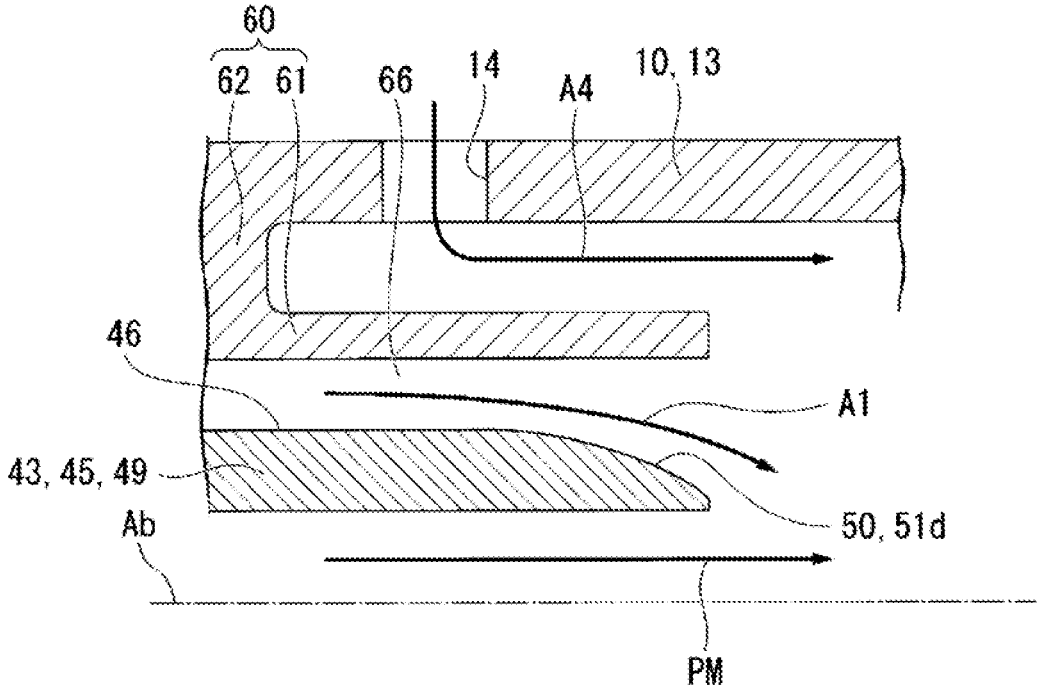
FIG. 13 is a cross-sectional view of the vicinity of a first outer circumference portion of the main burner cylinder according to a fifth modified example of the present invention.

For example, as illustrated in FIG. 13, an outer tapered surface 51*d* formed in a downstream end portion of the main burner cylinder 43 is a smooth curved surface, convex in a direction away from the burner axis Ab, on a virtual plane that contains the burner axis Ab and intersects with the outer tapered surface 51*d*. This curved surface may be a smooth curved surface that is concave in a direction toward the burner axis Ab.

FIG. 13 illustrates an example pertaining to the outer tapered surface 51*d* formed in the downstream end portion of the main burner cylinder 43. However, as long as the tapered surface is such that the plate thickness of the cylinder-forming plate gradually thins as the cylinder-forming plate extends toward the downstream side, the inner tapered surface formed in the downstream end portion of the main burner cylinder 43, the tapered surface formed in the outside flow path cylinder 60, and so on may each have a shape that is a curve on the virtual plane that contains the axis and intersects with the tapered surface.

Additionally, in the case where a tapered surface having a shape that is a curve on the virtual plane that contains the axis and intersects with the tapered surface is used, an average angle of the tapered surface relative to the axis or an angle of a line connecting an upstream end and a downstream end of the tapered surface relative to the axis is used as the angle of the tapered surface relative to the axis.

INDUSTRIAL APPLICABILITY

According to an aspect of the present invention, thermal damage and the like in a burner cylinder can be suppressed and the service life of a combustor can be extended.

REFERENCE SIGNS LIST

1 Compressor
4 Combustor
5 Turbine
10 Combustion liner
11 Connecting portion

13 Combustion portion
15 Combustion gas guide portion
20 Fuel jetting device
30 Pilot burner (second burner or diffusion combustion burner)
31 Pilot nozzle
32 Revolving plate
33 Pilot burner cylinder
34 Main portion
35 Cone portion
40 Main burner (first burner or premixed combustion burner)
41 Main nozzle
42 Revolving plate
43 Main burner cylinder
44 Main portion
45 Extended portion
46 First outer circumference portion
47 Second outer circumference portion
48 Third outer circumference portion
49 Burner cylinder-forming plate
50 Tapered surface
51, 51*a*, 51*b*, 51*c*, 51*d* Outer tapered surface
52, 52*a* Inner tapered surface
60 Outside flow path cylinder
64 Outer tapered surface
65 Inner tapered surface
66 First purge air flow path
67 Second purge air flow path
68 Third purge air flow path
Ab Burner axis
Ac Combustor axis
Ar Rotational axis
Da Axial direction
A Air
A1 First purge air
A2 Second purge air
A4 Film air
F Fuel
PM Premixed gas

The invention claimed is:

1. A combustor comprising:

a plurality of first burners, each of the plurality of first burners having:

a first nozzle configured to spray fuel;

a first burner cylinder, having a cylindrical shape surrounding an outer circumference of the first nozzle, wherein the first nozzle has a rod-shaped portion centered on a first burner axis;

an outside flow path cylinder, surrounding an outer circumference of at least a downstream end portion of each of the first burner cylinders, that forms, between an outer circumferential side of each of the first burner cylinders and an inner circumferential side of the outside flow path cylinder, a purge air flow path along which air can flow toward a downstream side of each of the first burner cylinders;

a second burner having: a second nozzle, having a second rod-shaped portion centered on a second burner axis, that sprays the fuel; and a second burner cylinder, having a cylindrical shape surrounding an outer circumference of the second nozzle, that jets the air and the fuel from the second nozzle, from an upstream side corresponding to one side in an axial direction along which the second burner axis extends, toward a downstream side corresponding to another side in the axial direction, wherein each of the first burner cylinders is configured to have a length longer than that of the respective first nozzle so as to cover all of the respective first nozzle and to jet a premixed gas generated by mixing the air and the fuel from the respective first nozzle from inside of the first burner cylinder at the upstream side toward the downstream side;

wherein an outer tapered surface is formed in an outer circumference of the downstream end portion of each of the first burner cylinders such that a plate thickness of a burner cylinder-forming plate that forms each of the first burner cylinders gradually thins as the burner cylinder-forming plate extends toward the downstream side, and an outer tapered surface formation width of the outer tapered surface in a plate thickness direction is no less than half a plate thickness of a part of the burner cylinder-forming plate where the outer tapered surface is not formed;

wherein the plurality of first burners are arranged in a circumferential direction around the second burner;

the first burner axes of the plurality of first burners and the second burner axis of the second burner are parallel to each other;

a first outer circumference portion that is a part of the outer circumference of each of the first burner cylinders faces a part of an inner circumference of the outside flow path cylinder such that a first purge air flow path serving as the purge air flow path is formed between the first outer circumference portion and the part of the inner circumference of the outside flow path cylinder;

a second purge air flow path in which the air flows toward the downstream side is formed between parts of an outer circumference of the second burner cylinder of the second burner and a second outer circumference portion of each of the first burner cylinders;

the second outer circumference portions are arranged closer to the second burner axis than the first outer circumference portions such that the second outer circumference portions face the first outer circumference portions, and are adjacent to the second burner cylinder; and the second outer circumference portions are inclined toward the downstream side of the first burner axes.

2. The combustor according to claim 1, wherein an inner tapered surface is formed in an inner circumferential side of each of the first burner cylinders and a width obtained by combining the outer tapered surface formation width of the outer tapered surface in the plate thickness direction and an inner taper formation width of the inner tapered surface in the plate thickness direction is no less than half the plate thickness of the part of the burner cylinder-forming plate where neither the inner tapered surface nor the outer tapered surface is formed.

3. The combustor according to claim 2, wherein the outer tapered surface formation width of the outer tapered surface in the plate thickness direction is greater than the inner taper formation width of the inner tapered surface in the plate thickness direction.

4. The combustor according to claim 1, wherein an angle of an outer tapered surface in the second outer circumference portions relative to the respective first burner axis is greater than an angle of the outer tapered surface in the first outer circumference portions relative to the respective first burner axis.

5. The combustor according to claim 4, wherein each of the plurality of first burners is a premixed combustion burner that burns the fuel jetted from the first burner cylinder through premixed combustion;

the second burner is a diffusion combustion burner that burns fuel jetted from the second burner cylinder through diffusion combustion; and the outside flow path cylinder has a cylindrical shape centered on the second burner so as to cover the plurality of first burners.

6. The combustor according to claim 1, wherein an outside flow path cylinder tapered surface is formed in a downstream end portion of the outside flow path cylinder such that a plate thickness of an outside flow path cylinder-forming plate that forms the outside flow path cylinder gradually thins as the outside flow path cylinder-forming plate extends toward the downstream side, and a tapered surface formation width of the outside flow path cylinder tapered surface in the plate thickness direction of the outside flow path cylinder-forming plate is no less than half the plate thickness of the outside flow path cylinder-forming plate.

7. A gas turbine comprising:

the combustor according to claim 1;

a compressor for compressing air and supplying the compressed air to the combustor; and a turbine configured to be driven by combustion gas formed by burning the fuel in the combustor.

* * * * *